US005931178A

United States Patent [19]

Pfarr et al.

[11] Patent Number: 5,931,178

[45] Date of Patent: Aug. 3, 1999

[54] HIGH-SPEED WATER JET BLOCKER

[75] Inventors: Craig E. Pfarr, Issaquah; Norman A. Rudy; Darren P. Wattles, both of Renton, all of Wash.

[73] Assignee: Design Systems, Inc., Redmond, Wash.

[21] Appl. No.: 08/618,319

[22] Filed: Mar. 19, 1996

[51] Int. Cl.[6] ..... F15C 3/10

[52] U.S. Cl. ..... 137/14; 137/806; 137/831; 137/338

[58] Field of Search ..... 137/829, 831, 137/806, 14, 15, 338

[56] References Cited

U.S. PATENT DOCUMENTS

| | | | |
|---|---|---|---|
| 1,831,791 | 11/1931 | Mihalyi . | |
| 2,408,603 | 10/1946 | Braithwaite et al. | 137/829 |
| 3,543,798 | 12/1970 | Briguglio | 137/829 |
| 3,678,746 | 7/1972 | Corey | 137/829 |
| 3,934,603 | 1/1976 | Avery | 137/829 |
| 4,603,835 | 8/1986 | deMey, II . | |
| 4,693,153 | 9/1987 | Wainwright et al. . | |
| 4,920,841 | 5/1990 | Johnson . | |

FOREIGN PATENT DOCUMENTS

| | | |
|---|---|---|
| 0 280 861 A1 | 1/1988 | European Pat. Off. . |
| 92924590 | 1/1995 | European Pat. Off. . |
| WO 93/10950 | 6/1993 | WIPO . |

*Primary Examiner*—A. Michael Chambers
*Attorney, Agent, or Firm*—Christensen O'Connor Johnson & Kindness PLLC

[57] ABSTRACT

An apparatus and method for performing high speed interruption of the flow of a very fine, high pressure, high speed water jet 12 of the type used to cut foods, paper, and other goods. The water jet 12 is interrupted by a pivotal blocking bar 22 within a blocker housing. The blocking bar 22 is pivoted in a collar 24*b* to a first desired position out of the path of water jet 12 or to a second desired position for blocking the path of water jet 12. A pivot arm 28, controlled by an output shaft 30 of a rotary actuator 32, controls the rotation of the blocking bar 22. A high pressured airflow is introduced into the device for controlling the exhaustion of blocked water within the device and for cooling the rotary actuator 32.

13 Claims, 2 Drawing Sheets

HIGH-SPEED WATER JET BLOCKER

FIELD OF THE INVENTION

This invention relates generally to a product cutter utilizing a high pressure fluid jet, and more particularly, to methods and apparatus for selectively interrupting the flow of a stream of high pressure water used to cut products.

BACKGROUND OF THE INVENTION

Fluid jets have been used to cut food, paper and other products for years. The advantages are numerous: there are no blades that need to be sharpened or replaced, no dust is created, and cuts can be quick and clean. The cutting is done with a thin, high pressure, high velocity stream of water or other fluid. Pressurized water is ejected from a very small orifice to create the jet. When the jet touches the product, a thin slice is removed without any appreciable water being absorbed into the product.

Specific manipulation of the flow of fluid emanating from the water jet accurately cuts shapes in the products. Many of the shapes desired require precise high speed interruption of the water jet. The greater the detail of the desired shape of the product, the faster the interruption of the jet must be in order to attain such detail. Also, a higher rate of interruption results in less processing time.

Various ways have been taught to interrupt the water jet at high speeds. One such method of interruption is that of inserting an object between the source of the high speed water jet and the product. A linear actuator pressurized by air that forces a plunger pin into the path of the water jet is a generally known tool for performing this method. A spring provides a retracting force for the plunger pin. Existing plunger pin devices are capable of reaching closure times of 50–90 ms and thereby limit the speed at which products may be cut by the water jet.

U.S. Pat. No. 4,693,153 (Wainwright et al.) discloses another water jet interruption technique. When interruption of the object cutting jet is desired, a second high pressure fluid is directed at the object cutting jet so as to disperse the latter and impair its object cutting properties. The device that controls the second fluid flow is similar to the plunger pin device. A solenoid device within the jet obstructer device controls the fluid flow from the jet obstructer device. An energized solenoid closes a plunger mechanism that is normally held in an open position by a spring. In the open position the mechanism provides high pressure fluid to interrupt the object cutting water jet. Similar to the plunger pin device, this device also lacks the high speed interruption capabilities necessary for cutting products as rapidly as may be desired.

International application number WO93/10950 discloses a valve for controlling a constantly running liquid cutting jet. A pneumatically powered rotary cylinder 2 is attached to one end of and elongate plate 1 to rotate the opposite end of the plate in and out of the path of flow of the liquid cutting jet. However, the opening and closing times for this rotary plate are only slightly better than that of existing plunger pin devices. Also, the cutting jet strikes one position on the plate resulting in frequent replacement of the plate.

The prior art described above fails to address the issue of efficient removal of deflected cutting fluid for avoiding absorption into the product. Also the issue of high temperature caused by high speed operation is not addressed. Consistent high temperatures will cause premature failure of the valve device.

The devices currently in use, as exemplified by those described above, do not effectively and efficiently solve the problem of cutting precise shapes at high speeds that require a high frequency of water jet interruption. Accordingly, the present invention was developed, and provides significant advantages over previous devices or methods to cut shapes with fluid jets.

SUMMARY OF THE INVENTION

In accordance with this invention, a method and apparatus for controlling the flow of a stream of high pressure fluid used for cutting an object is disclosed. The apparatus includes a main housing with a blocking device and a rotary actuator disposed within. The rotary actuator generates a rotary output torque. The apparatus also includes a coupling mechanism that provides a couple between the blocking device and the rotary actuator to transmit the rotary output torque from the rotary actuator to the blocking device to cause the blocking device to shift into the path of travel of the stream of high pressure fluid to disrupt the flow of the high pressure stream and out of the path of the high pressure fluid to not disrupt the flow of the high pressure stream.

In accordance with further aspects of this invention, the blocking device is a rod and the coupling mechanism couples one end portion of the rod to the rotary actuator.

In accordance with still further aspects of this invention, a support pivot supports the rod, wherein the support for the rod is disposed with the housing between the path of travel of the stream of high pressure fluid and the rod's connection to the coupling mechanism.

In accordance with yet other aspects of this invention, the rod is adjustable orthogonally to the flow of the high pressure stream. Also, the rod is removable from the housing and rotatable within the housing.

In accordance with other aspects of this invention, the rotary actuator toggles to predefined limits that are controlled by a controlling mechanism.

In accordance with other aspects of this invention, high pressure air is directed past the rotary actuator for cooling the rotary actuator. The directed high pressure air is further directed to expel fluid from the housing remaining from the disrupted flow of the high pressure stream.

As will be readily appreciated from the foregoing summary, the invention provides a new and improved method and apparatus for controlling the flow of a stream of high pressure fluid used for cutting. Because the method and apparatus does not require the use of a plunger pin device, the disadvantages associated with the use of connectors, briefly described above, are avoided.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
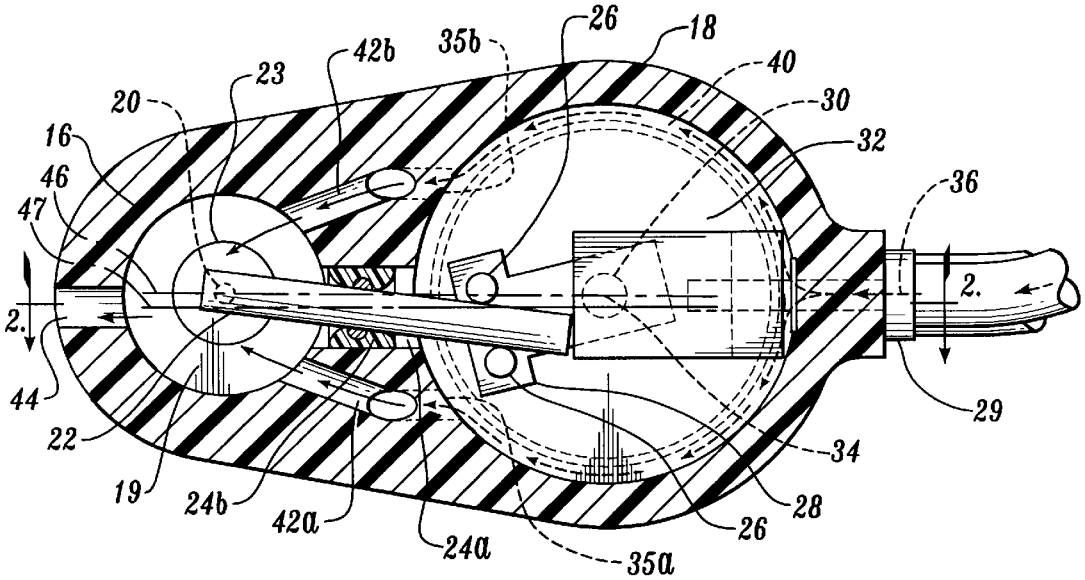
FIGS. 1A and 1B are horizontal cross-sectional views.
Figure 1B:
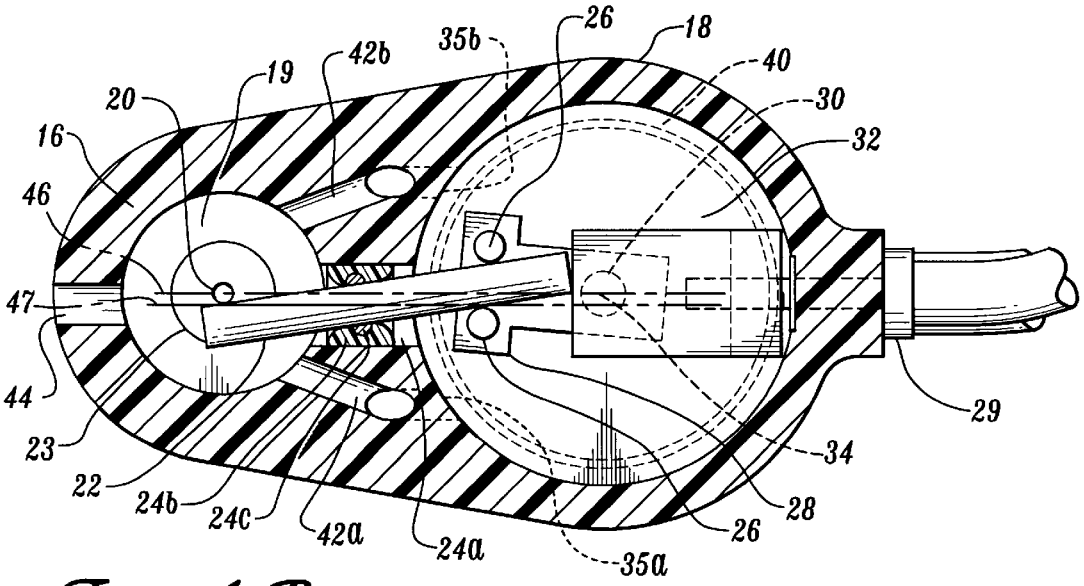
Figure 2:
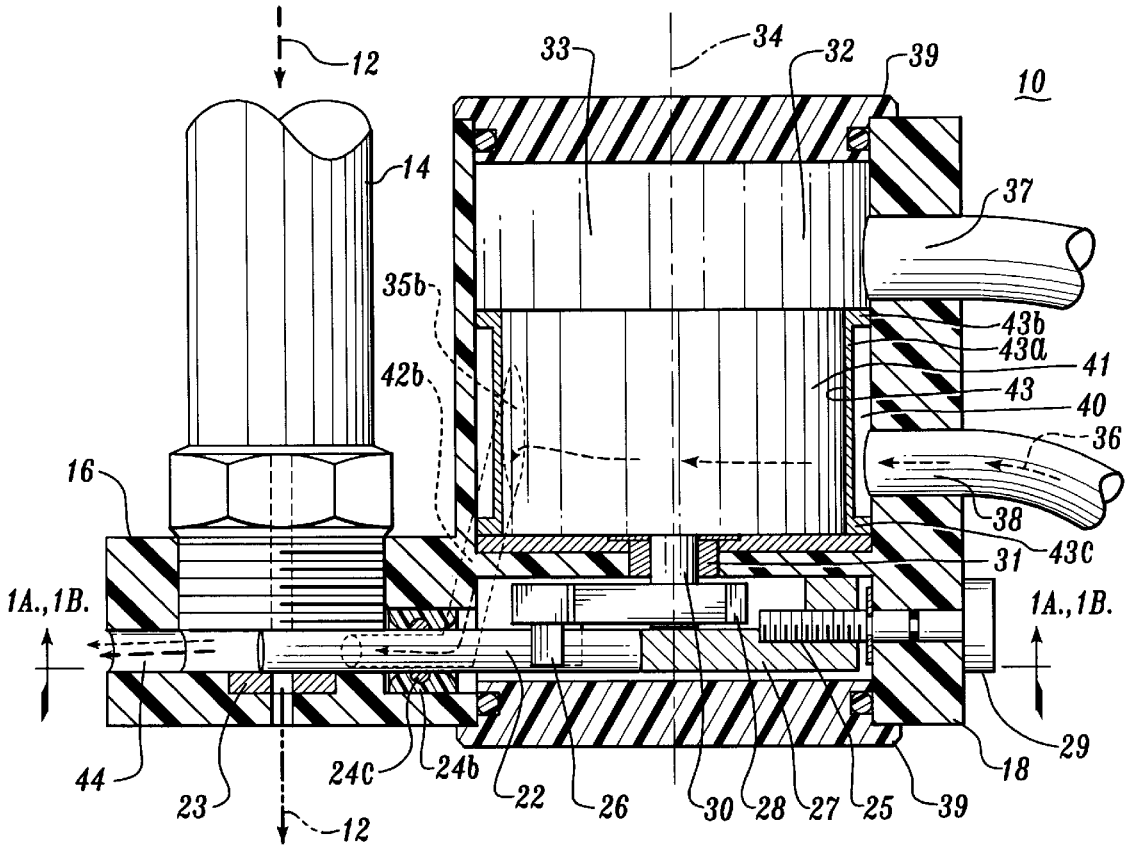
FIG. 2 is a vertical cross-sectional view of the invention.

A first preferred embodiment of the present invention is illustrated in FIG. 2. The high speed water jet blocker 10 includes a main housing 18, with a projecting portion 16. The main housing 18 and the projecting portion 16 include cavities with a connecting passageway for housing a rotary actuator 32, a blocking bar 22, an output shaft 30, a pivot arm 28, vertical pins 26 and a collar 24*b*. The main housing 18 and projecting portion 16 are preferably composed of a high density polypropylene, such as Delrin®. For the purposes of this detailed description, the high speed water jet blocker 10 shown in FIG. 2 is in an upright position with a top and bottom where the projecting portion 16 of the water jet blocker 10 is attached to and flush with the base of the main housing 18. Also, the views of FIGS. 1A and 1B are toward the bottom of the water jet blocker 10.

Within projecting portion 16 is a downwardly extending counterbore cavity 19 that opens at the top of the projecting portion 16. The open upper end of the counterbore cavity 19 receives a nozzle 14 attached to the discharge end of a high pressure water line (not shown). The nozzle 14 supplies (discharges) a very fine, high pressure, high speed fluid or water jet 12 in a vertically descending direction into counterbore cavity 19. A small opening 20 at the base of counterbore cavity 19 provides an opening for the high speed water jet 12 to exit projecting portion 16 for the purpose of cutting products located below the blocker 10. Small opening 20 is large enough to avoid interfering with the flow of water jet 12. Also, a disk-shaped carbide insert 23 surrounds small opening 20, protecting it from wear due to high pressure deflected fluid.

Also located within counterbore cavity 19 of projection portion 16 is the distal end of a pivotal blocking bar 22. The pivotal blocking bar 22 has two operational positions within the counterbore cavity 19. As shown in FIG. 1A, the first operational position is a water jet blocking or interrupting position. Blocking bar 22 provides interruption of the flow of the water jet 12 because of its location over small opening 20. As shown in FIG. 1B, the other operational position is a cutting position since blocking bar 22 is dislocated laterally from small opening 20 thereby providing an uninterrupted flow of water jet 12.

As shown in FIG. 1A, a lateral passageway 24*a* creates a path from the counterbore cavity 19 to a lower cavity 25 within main housing 18. Lower cavity 25 creates an opening at the base of main housing 18 and extends vertically to a level higher than passageway 24*a*, but lower than the top of projecting portion 16, as shown in FIG. 2. Blocking bar 22 is disposed within passageway 24*a* and supported by a collar 24*b* to extend into lower cavity 25. Collar 24*b* is preferably composed of stainless steel and press fit within the passageway 24*a*. An O-ring seal 24*c* is used to prevent water from entering lower cavity 25. The O-ring seal is seated within a groove formed in the internal diameter of the collar 24*b*. The internal ends of the collar 24*b* are beveled allowing the bar to pivot freely side-to-side, as discussed more fully below, without interference with the collar.

The proximal end of blocking bar 22 that extends into the lower cavity 25 extends between a pair of spaced apart pins 26 extending transversely downwardly from the distal end of a pivot arm 28. The proximal end of pivot arm 28 is securedly connected to an output shaft 30. As shown in FIG. 2, output shaft 30 extends through a vertical opening 31 at the top of lower cavity 25 from a rotary actuator 32 contained in an upper cavity 33 formed within main housing 18. The upper cavity has a base that is approximately at the same vertical elevation as the top of projecting portion 16. The upper and lower cavities are approximately equal in diameter and both have a larger diameter than the diameter of counterbore cavity 19. Also, upper cavity 33 is open at the top of main housing 18. Both cavity openings are closed by corresponding cavity caps 39.

As shown in FIG. 1A, the output shaft 30, pivoted by the rotary actuator 32, is at a maximum counter-clockwise position. When the output shaft 30 of rotary actuator 32 is in such maximum counter-clockwise position, pivot arm 28 is also at a maximum counter-clockwise position, thereby pivoting the blocking bar 22 in a clockwise direction about collar 24*b* to block the flow of water jet 12. As shown in FIG. 1B, rotary actuator 32 rotates the output shaft 30 and pivot arm 28 to a fully clockwise position. Correspondingly, the blocking bar 22 is pivoted in a counter-clockwise direction about collar 24*b*, thereby retracting the blocking bar 22 out of the path of the water jet 12 to allow the water jet to flow through the water jet blocker 10. The total range of rotation of the output shaft 30 and pivot arm 28 is approximately forty-five degrees with somewhat equal rotation relative to a longitudinal centerline 46 extending between the centers of small opening 20 and output shaft 30. As shown in FIGS. 1A and 1B, the longitudinal centerline 47 of passageway 24*a* is offset slightly from longitudinal centerline 46. Passageway 24*a* is offset so blocking bar 22 covers small opening 20 when the output shaft 30 and pivot arm 28 are in the fully counter-clockwise position and so blocking bar 22 does not block small opening 20 when the output shaft 30 and pivot arm 28 are in the fully clockwise position.

An exhaust port 44 provides a lateral opening from counterbore cavity 19 at a position on the counterbore cavity 19 diametrically opposed from passageway 24*a*. The base of exhaust port 44 is shown at the same elevation as blocking bar 22. Exhaust port 44 provides a route for fluid to escape counterbore cavity 19 during water jet interruption.

A further aspect of the present invention is illustrated in FIGS. 1A, 1B and 2. An annular cavity 40 is defined by the internal diameter of the upper cavity 33 and a metallic sleeve 43. Ideally the sleeve 43 is composed of aluminum or similar metal. Sleeve 43 includes a cylindrical body portion 43*a* and upper and lower flanges 43*b* and 43*c* that extend radially outwardly from the upper and lower ends of the sleeve. The sleeve body portion 43*a* snugly surrounds the lower portion 41 of the actuator, and the outer circumferences of the flanges 43*b* and 43*c* snugly engage against the inner surface of the main housing 18 that defines the outer diameter of the annular cavity 40. It will be appreciated that the upper, lower and inner walls of annular cavity 40 are formed by the flanges 43*b* and 43*c* and body portion 43*a*, respectively, of the sleeve 43. Also, sleeve 43 occupies the space in upper cavity 33 below an upper portion of rotary actuator 32 not occupied by the lower portion 41 of rotary actuator 32 and annular cavity 40.

An inlet port 38 leads into the annular cavity 40, and a pair of outlet ports 35*a* and 35*b* leads away from annular cavity 40. The input port 38 is located at the lower portion of the annular cavity 40 along longitudinal centerline 46. Input port 38 is connectable to a pressurized air source. Also, input port 38 is located on the main housing 18 distally opposed from projecting portion 16.

Exhaust ports 35*a* and 35*b* are located approximately equidistant from longitudinal centerline 46. The exhaust ports connect to air passageways 42*a* and 42*b* leading between annular cavity 40 and counterbore cavity 19. Air passageways 42*a* and 42*b* extend down main housing 18 angled slightly towards projecting portion 16. Within projecting portion 16, air passageways 42*a* and 42*b* extend horizontally at an elevation approximately equal to the elevation of passageway 24*a*. The horizontal sections of the air passageways 42*a* and 42*b* angle toward the center of counterbore cavity 19 to deliver, through openings in counterbore cavity 19, high pressure air on either side of blocking bar 22. When an air source is attached, pressurized air follows air path 36 and enters inlet port 38, travels through annular cavity 40, exits through exhaust ports 35*a* and 35*b*, travels through passageways 42*a* and 42*b*, and enters counterbore cavity 19 to blow excess or deflected fluid out of counterbore cavity 19 through exhaust port 44. Pressurized air continuously flows thus providing a cooling effect on sleeve 43 which conducts heat away from rotary actuator 32.

As noted above, sleeve 43 in addition to defining portions of annular cavity 40, also serves to seal the lower portion 41 of the rotary actuator 32 from moisture. Such moisture may be latent within the air supplied to the jet blocker 10 through input port 38. Also, the moisture may originate from the water jet 12 and may "back up" into the cavity 40 through the air passageways 42*a* and 42*b* and exhaust ports 35*a* and 35*b*.

Figure 3:
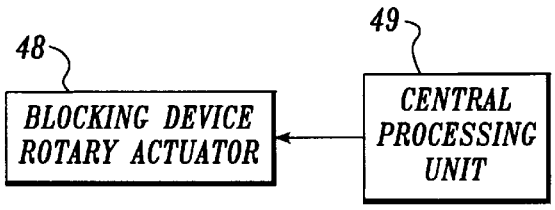
FIG. 3 is a block diagram of the invention.

Rotary actuator 32 is a device that converts electric energy into a controlled rotary force that is quickly reversible in the rotary direction. The rotary actuator can pivot the pivot arm 28 into the path of the water jet 12 and reverse direction to retract the pivot arm out of the path of the water jet in as little as 9 milliseconds. Electrical energy is provided to a rotary actuator 32 from a power supply through power cord port 37 located above input port 38, as shown in FIG. 2. The water jet blocker 10 is controlled by and used in various systems. As shown in FIG. 3, the present invention uses some form of processing unit or computer 49 to supply the rotary actuator 32 with a controlled electrical energy supply. Processing unit 49, with predefined routines, controls an electrical signal sent to rotary actuator 32, thereby controlling the cutting pattern of water jet blocker 10. Multiple waterjet blockers can be used in conjunction with a computer controller for performing simultaneous high speed interactive cuts.

Some systems that incorporate the blocking device of the present invention are designed to operate continuously or with very little down time thereby requiring a cutting device with effective and efficient maintenance. Due to the destructive force of high speed water jet 12, blocking bar 22 is eventually eroded away, thereby reducing the efficient feature of the system. One solution is a bar adjustment mechanism 27 and 29 within the water jet blocker 10. A knurled lead screw 29 controls the longitudinal position of an adjusting backstop 27. As shown in FIGS. 1A, 1B and 2, screw 29 is sealed with respect to housing 18 by an O-ring in a through hole located below input port 38 at approximately the elevation center of lower cavity 25. Also, the thread, leading portion of screw 29 extends into lower cavity 25 to a position free from interfering with pivot arm 28.

Backstop 27 is positioned within lower cavity 25. The backstop includes a rear portion that includes an upwardly extending abutment wall having a threaded opening formed therein to receive the complementarily threaded lead portion of screw 29. The backstop also includes a front or leading end that abuts against the proximal (rear) end of blocking bar 22. Rotation of screw 29 adjusts the longitudinal (forward and rearward) position of backstop 27, thereby correspondingly adjusting the longitudinal position of blocking bar 22. Adjustment of the longitudinal position of the bar within the blocker 10, provides multiple water jet contact locations along the length of the bar, effectively delaying failure of the bar.

Another solution is a quick and efficient bar rotation or removal. Under normal operating conditions, blocking bar 22 maintains its longitudinal as well as its rotational position relative to water jet 12. This lack of "walking" movement of the bar causes water jet 12 to consistently strike blocking bar 22 at the same spot on the bar. As can be appreciated, eventually the water jet 12 erodes away enough of the bar 22 to cause the bar to sever or otherwise fail. Quick and convenient rotation of the bar provides extended bar life, thereby improving the maintainability of the bar.

Bar composition is also important in reducing maintenance time. The bar could be composed of titanium which is highly resistant to erosion by the high pressure water jet. The bar alternatively could be composed of a carbide core covered with a stainless steel cover sized to impose a high compressive load on the core. Applicants have found that although the stainless steel cover may erode rather quickly, the loaded carbide core is highly resistant to erosion, much more so than if the stainless steel cover were not used.

While a preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for controlling the flow of a stream of high pressure fluid used for cutting an object, the method comprising the steps of:

(a) generating a rotary output torque within a housing by using a rotary actuator;

(b) transmitting said rotary output torque to a blocking device within said housing to cause the blocking device to shift into the path of travel of the high pressure fluid stream to disrupt the flow of the high pressure fluid stream and out of the path of the high pressure fluid stream to not disrupt the flow of the high pressure fluid stream; and (c) substantially continuously directing high pressure air past said rotary actuator for cooling of said rotary actuator.

2. The method of claim 1, further comprising the step of directing said high pressure air to expel fluid from the housing remaining from the disrupted flow of the high pressure fluid stream.

3. The method of claim 1, wherein said blocking device is a rod.

4. The method of claim 3, further comprising the step of supporting said rod thereby creating a pivot point for said rod.

5. The method of claim 3, further comprising the step of adjusting the position of said rod orthogonal to said flow of the high pressure fluid stream.

6. The method of claim 1, wherein said rotary actuator toggles between predefined limits.

7. The method of claim 6, further comprising the step of controlling the toggling of said rotary actuator.

8. A method for controlling the flow of a stream of high pressure fluid used for cutting an object, the method comprising the steps of:

generating a rotary output torque within a housing by using a rotary actuator;

transmitting said rotary output torque to a blocking device within said housing to cause the blocking device to shift into the path of travel of the high pressure fluid stream to disrupt the flow of the high pressure fluid stream and out of the path of the high pressure fluid stream to not disrupt the flow of the high pressure fluid stream; and directing high pressure air proximate the high pressure fluid stream to expel fluid from the housing remaining from the disrupted flow of the high pressure fluid stream.

9. A method for controlling the flow of a stream of high pressure fluid used for cutting an object, the method comprising the steps of:

generating a rotary output torque within a housing by using a rotary actuator;

transmitting said rotary output torque to a blocking device comprising a longitudinal member within said housing to cause the longitudinal member to rotate about a pivot point into the path of travel of the high pressure fluid stream to disrupt the flow of the high pressure fluid stream and out of the path of the high pressure fluid stream to not disrupt the flow of the high pressure fluid stream; and adjusting the position of the longitudinal member orthogonal to said flow of the high pressure fluid stream.

10. A method for controlling the flow of a stream of high pressure fluid, the method comprising the steps of:

generating a rotary output torque within a housing by using a rotary actuator; and transmitting the rotary output torque to a pivot arm coupled to the rotary actuator and to a blocking device to cause the pivot arm to toggle, thereby causing the blocking device to rotate about a pivot point into the path of travel of the high pressure fluid stream to disrupt the flow of the high pressure stream and out of the path of the high pressure fluid stream to not disrupt the flow of the high pressure fluid stream.

11. The method of claim 10, further comprising the step of adjusting the position of the blocking member orthogonal to the flow of the high pressure fluid stream.

12. The method of claim 10, further comprising the step of directing high pressure air past the rotary actuator for cooling of the rotary actuator.

13. The method of claim 10, further comprising the step of directing high pressure air proximate the high pressure fluid stream to expel fluid from the housing remaining from the disrupted flow of the high pressure fluid stream.

* * * * *